US010752398B2

(12) United States Patent
Hauser et al.

(10) Patent No.: US 10,752,398 B2
(45) Date of Patent: Aug. 25, 2020

(54) POURING ELEMENT FOR A COMPOSITE PACKAGING AND COMPOSITE PACKAGING HAVING A POURING ELEMENT

(71) Applicant: SIG Technology AG, Neuhausen am Rheinfall (CH)

(72) Inventors: Philippe Hauser, Andelfingen (CH); Felix Rigling, Dettighofen (CH); Markus Wassum, Buch (CH)

(73) Assignee: SIG Technology AG, Neuhausen am Rheinfall (CH)

( * ) Notice: Subject to any disclaimer, the term of this patent is extended or adjusted under 35 U.S.C. 154(b) by 0 days.

(21) Appl. No.: 16/304,371

(22) PCT Filed: May 10, 2017

(86) PCT No.: PCT/EP2017/061114
§ 371 (c)(1),
(2) Date: Nov. 26, 2018

(87) PCT Pub. No.: WO2017/207227
PCT Pub. Date: Dec. 7, 2017

(65) Prior Publication Data

US 2019/0193894 A1 Jun. 27, 2019

(30) Foreign Application Priority Data

May 31, 2016 (DE) ..... 10 2016 110 046
May 31, 2016 (EP) ..... 16020203

(51) Int. Cl.
*B65D 5/74* (2006.01)

(52) U.S. Cl.
CPC ..... *B65D 5/748* (2013.01)

(58) Field of Classification Search
CPC ..... B65D 5/748; B65D 39/08; B65D 47/14; B65D 51/243
(Continued)

(56) References Cited

U.S. PATENT DOCUMENTS 5,020,690 A * 6/1991 Kishikawa ..... B65D 5/748 222/541.2
5,960,992 A * 10/1999 Bernstein ..... B65D 5/748 222/541.2
(Continued)

FOREIGN PATENT DOCUMENTS

DE 102006016113 B3 8/2007
DE 102013101526 A1 8/2014
(Continued)

OTHER PUBLICATIONS

Chinese Office Action 201780034146.X dated Dec. 3, 2019.

*Primary Examiner* — Vishal Pancholi
(74) *Attorney, Agent, or Firm* — The Webb Law Firm

(57) ABSTRACT

A pouring element for a composite packaging, in particular a beverage carton for liquid foodstuffs is shown and described, comprising a basic body having a fastening flange and a pouring tube, a cutting element which is arranged and guided in the pouring tube and a closure cap which can be joined to the basic body, wherein during actuation for the first time, the cutting element can be driven by first drive means formed on the closure cap and by second drive means formed on the inner wall of the cutting element and wherein the movement of the cutting element follows different gradients, and a composite packaging is also shown and described, in particular a beverage carton for liquid foodstuffs, having a pack gable-top panel which is suitable for receiving a pouring element. In order to improve the drive and guidance of the cutting element during opening of the composite packaging, simultaneously with optimised pro-
(Continued)

ducibility, and to facilitate the opening of the composite packaging in the region of a weakening in the pack material, it is provided that the second drive means is configured as a rib which runs obliquely and includes an angle with the longitudinal direction, and that the end face of the rib partly projects over the foot thereof and thus includes a valley angle.

14 Claims, 4 Drawing Sheets

(58) Field of Classification Search
USPC ..... 222/80–91, 541.2, 541.6
See application file for complete search history.

(56) References Cited

U.S. PATENT DOCUMENTS

| | | | | |
|---|---|---|---|---|
| 7,458,486 | B2 | 12/2008 | Weist et al. | |
| 7,959,032 | B2 | 6/2011 | Bolli | |
| 8,672,167 | B2 | 3/2014 | Leuenberger et al. | |
| 2005/0236425 | A1* | 10/2005 | Casale | B65D 5/748 222/83.5 |
| 2005/0242113 | A1* | 11/2005 | Weist | B65D 5/748 222/83.5 |
| 2006/0071000 | A1* | 4/2006 | Weist | B65D 5/748 220/278 |
| 2008/0105640 | A1 | 5/2008 | Ott | |
| 2008/0210745 | A1 | 9/2008 | Rigling | |
| 2009/0302037 | A1* | 12/2009 | Rigling | B65D 5/748 220/258.4 |
| 2010/0264146 | A1* | 10/2010 | Casale | B65D 5/029 220/278 |
| 2013/0256336 | A1* | 10/2013 | Himmelsbach | B65D 5/748 222/81 |
| 2015/0375911 | A1 | 12/2015 | Stirn | |

FOREIGN PATENT DOCUMENTS

| | | | |
|---|---|---|---|
| WO | 2004000667 | A1 | 12/2003 |
| WO | 2006050624 | A1 | 5/2006 |
| WO | 2007113215 | A1 | 10/2007 |
| WO | 2009068671 | A1 | 6/2009 |
| WO | 2015058912 | A1 | 4/2015 |

* cited by examiner

POURING ELEMENT FOR A COMPOSITE PACKAGING AND COMPOSITE PACKAGING HAVING A POURING ELEMENT

CROSS-REFERENCE TO RELATED APPLICATIONS

This application is the United States national phase of International Application No. PCT/EP2017/061114 filed May 10, 2017, and claims priority to German Patent Application No. 10 2016 110 046.3 and European Patent Application No. 16020203.2, both filed May 31, 2016, the disclosures of which are hereby incorporated in their entirety by reference.

The invention relates to a pouring element for a composite packaging, in particular for a beverage carton for liquid foodstuffs, comprising a basic body having a fastening flange and a pouring tube, a cutting element which is arranged and guided in the pouring tube and a closure cap which can be connected to the basic body, and during first time actuation, the cutting element can be driven by first drive means formed on the closure cap and by second drive means formed on the inner wall of the cutting element, and the movement of the cutting element follows different gradients, and the invention also relates to a composite packaging, in particular to a beverage carton for liquid foodstuffs, having a pack gable-top panel which is suitable for receiving a pouring element.

Field of the Invention

In the packaging technology sector, composite packagings have long been part of the current prior art. Thus, for example, beverage cartons consist of different packaging materials, such as paper and plastics which, when fully joined and printed, form a pack laminate. The layer structure can vary subject to requirements, thus for example an aluminium layer is also inserted for aseptic products to achieve a good barrier effect with respect to gases and light. Often, but nor always, the laminate is cut to the size of the pack during its production and in this way, so-called packaging pre-cut parts (blanks) are formed. Alternatively, the pack laminate is also supplied as continuous material (rolled goods) and is not cut to size until later.

The actual forming and filling processes of the packaging and the sealing process to form a pack are carried out in a packaging machine which is often also called a form/fill/seal machine based on its main functions. Possible filling products include mainly liquid foodstuffs, such as beverages, soups or yoghurt. Set, pasty or lumpy products or the like are also conceivable.

Packagings of the mentioned type are sometimes also provided with pouring elements. These generally provide the consumer with the option of reclosing the pack in addition to allowing the filling product to be poured out in a controlled manner. Often and mainly for aseptic use, a first opening function is also provided for the pack. In this respect, the pack which was previously sealed in a gas-tight manner is opened for the first time. This can be performed, for example, by a ring-pull or a pull tab or also by a piercing and/or cutting device. Piercing and/or cutting devices of this type are often configured as sleeve-like cutting elements (cutting rings) which are coupled to the screw cap for example by drive means, so that the pack is simultaneously cut open by the rotational actuation of the screw cap.

DESCRIPTION OF RELATED ART

International patent application WO 2007/113215 A1 belonging to the Applicant discloses for example a three-part pouring element. Basic body, screw cap and cutting sleeve are first of all produced individually in the injection moulding process and, when assembled, they produce a functional pouring element which can remain joined to a filled composite packaging described above by a fastening flange on the basic body. When the screw cap is actuated for the first time by the consumer, the cutting element moves in the direction of a region to be opened of the composite packaging and cuts this open by means of a cutting edge specifically provided for this purpose. The cutting element is driven by carrier webs which are formed in the inner region of the cap and act on corresponding hook-like projections on the cutting element and thus set the cutting element into rotation during the first opening procedure. These carrier webs are such that they can transmit rotational forces in a torsion-resistant manner due to their curved concentric web shape, but during a reclosing procedure, they can deflect radially inwards. A rotational movement introduced thus is converted into a movement which follows a helical curve via an outer thread on the cutting element and via an inner thread on the basic body. The thread pairing allows a relatively secure guidance of the components, which is always desired, but restricts the kinematics of the cutting element to a constant advance. This can be disadvantageous, since with the mentioned type of packs, a so-called "PE tearing" can result during the severing procedure. In this respect, the polyethylene film is stretched in length, without being severed, which ends in a poor or even incomplete opening result, so that the product cannot be poured out in the required manner.

In order to overcome the problem, the Applicant proposed a solution, disclosed in international patent application WO 2004/000667 A1: a specifically staggered kinematics of the cutting element. The cutting element is firstly forced through in a purely axial manner and in this way, the composite packaging is pierced by a combined piercing and cutting member. Thereafter follows a pure rotation which exclusively allows the member to cut. To allow this specific kinematics, guide means are formed on the basic body and on the cutting element. For the drive of the cutting element by rotation of the screw cap, simple cams are formed on the inner wall of the cutting element, which act on the cylinder wall segments of the screw cap. Since there is always a risk of the cutting element tipping and/or tilting, the guide means and drive means are configured to be solid which results in a high consumption of material.

A better solution in respect of guidance and drive of the pouring element is disclosed in international patent application WO 2006/050624 A1 which also belongs to the Applicant. Here, the drive cams on the cutting element ware supplemented by a nail head-type extension. An extension of this type assists and improves the guidance of the cutting element, because it partly engages behind the cylinder wall segments and thus helps to prevent any tilting. Extensions of this type are expensive to produce as they require a relatively large amount of material behind the narrowing of the cam. In particular, relatively poor flow runs for the plastics and relatively high cycle times during injection moulding are entailed. Furthermore, drive elements of this type must always be of a stable configuration to ensure that under no circumstances will parts be able to break off and fall into the product.

SUMMARY OF THE INVENTION

On this basis, it is the object of the present invention to configure and develop a pouring element and a composite packaging of the type mentioned at the outset and previously described in detail in such a manner that the described disadvantages are overcome. In particular, the drive and guidance of the cutting element during opening of the composite packaging are to be improved with a simultaneously optimised producibility.

This object is achieved with a pouring element according to the preamble of claim 1 in that the second drive means is configured as a rib which runs obliquely and includes an angle with the longitudinal direction of the cutting element, and in that the end face of the rib partly projects over the rib foot thereof and thus includes a valley angle. When the movement of the cutting element follows different gradients, a second drive means, running obliquely to the longitudinal direction of the cutting element allows an improved torque transmission from the closure cap to the cutting element. In this respect, the force ideally acts exactly in the direction of movement of the cutting element. The rib without an extension has a solid strength. In particular, no notch stresses arise in the transition regions to further formed-on parts. Only intact parts can perform the functions intended therefor (for example drive function). Furthermore, under no circumstances can parts break off which, in the worst case scenario, could pass into the product which is ready for consumption. In addition, a rib without an extension is easier to realise in terms of production. Most parts produced by injection moulding do not have any additional constrictions which in no way adversely affect the filling of the cavity with regard to longer cycle times and/or a locally lower material quality. In addition, the guidance of the cutting element is assisted and improved by an end face of the rib which projects over the foot thereof.

The object on which the invention is based is also achieved by a composite packaging in which the pack gable-top panel has a local weakening in the pack material and a pouring element of this type is positioned and permanently joined such that when the pouring element is actuated for the first time, the cutting element is movable in the direction of the pack material weakening and this weakening can be severed so that the composite packaging is ready for emptying. The pouring element and composite packaging must always be closely adapted to one another. Thus, a precise positioning on a pack gable-top panel, provided therefor, is extremely important. On the one hand, the pouring element must remain joined to the composite packaging, on the other hand the cutting element has to become embedded in a precise manner in the pack material weakening produced for this purpose and to then sever it. This action alone allows a complete opening of the pack which is then ready for emptying.

A further teaching of the invention provides that the angle $\alpha$ includes 40° to 50°. With such an angular range, an optimum compromise is reached even with different gradients of the movement of the cutting element. In this respect, the advantages of a rib and of an improved drive do not have to be relinquished.

Another teaching of the invention provides that the angle $\beta$ includes 50° to 80°. Tests have shown that such a range of the valley angle provides a balanced solution between guide function and drive function. The drive means assists the cutting element guidance satisfactorily, but does not hinder the drive.

In a further advantageous embodiment, when the pack is closed again for the first time, the cutting element can be further driven by third drive means formed on the closure cap and by fourth drive means formed on the cutting element. After the pouring element has been actuated for the first time, the cutting element has performed its function of the first opening of the composite packaging. The first and second drive means are uncoupled. If, after the product has been poured out for the first time, the closure cap is reclosed, the third drive means on the closure cap and the fourth drive means on the cutting element ensure that the cutting ring is pressed further in the direction of the pack and said ring is brought into its end position so that the drive means is completely uncoupled.

In further expedient embodiments, the fourth drive means is configured as a second rib which runs obliquely and includes an angle $\gamma$ with the longitudinal direction, said angle $\gamma$ including 5° to 25°. An embodiment of this type provides a good solution to performing the described function. In particular, blocking of the closure cap is prevented in this way.

In further embodiments of the invention, the second rib includes on the contact surface side an obtuse angle $\delta$ of 100° to 130°. The advantage of an obtuse angle of this type is that the third drive means of the closure cap is provided with the possibility of a resilient deflecting and "sliding" action.

According to a particular type of embodiment of the invention, a third rib, standing transversely to the longitudinal direction is formed between the first rib and the second rib. In addition to affording additional reinforcement of the drive ribs, a horizontally running rib of this type also provides the advantage of a flat surface. A flat surface of this type can be desirable or necessary for the production in the injection moulding process, because as a functional surface, it can be used as the injection point and/or as the engagement point of the release pin for removing the part from the injection moulding tool.

According to further teachings of the invention, the first drive means are configured as first drive flanks which ideally have on the contact surface side an angular width such that they form with angle $\beta$ the complementary angle. If the first drive means is configured as thin-walled flanks, not only can material be invariably saved, which is desirable, but the flanks are also allowed a slight elastic deformation. A drive flank of this type, particularly with a contact surface-side complementary angle to angle $\beta$, can provide a particularly good drive and an additionally assisting guidance of the cutting element. Furthermore, if the third drive means is configured as a second drive flank, the closure cap can be produced in a particularly effective manner.

According to a particular type of embodiment of the invention, the weakening in the pack material is formed as a prelaminated hole. A specific preparation of this type of the pack material is particularly suitable for opening by a pouring element which is optimised in drive and guidance, because the severing does not have to be made through the entire material of the composite packaging.

BRIEF DESCRIPTION OF THE DRAWINGS

In the following, the invention is described in more detail with reference to the drawings which show only one embodiment. In the drawings.

DESCRIPTION OF THE INVENTION

Figure 1:
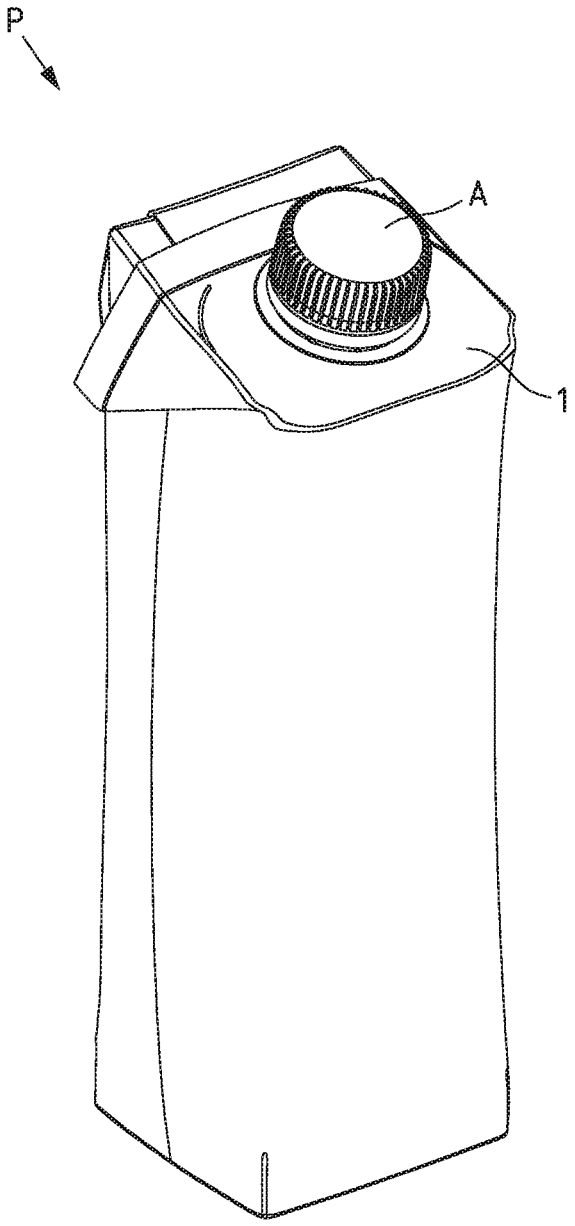
FIG. 1 shows a perspective view from above at the front of a composite packaging according to the invention with a pouring element.

The embodiment of a composite packaging P according to the invention, shown in FIG. 1, shows the composite packaging as a beverage carton. The composite packaging P consists of a pack material which forms a pack laminate from a sequence of flat-joined materials: polymer layers are laminated onto both sides of a cardboard carrier layer, and an additional aluminium layer protects the product of the composite packaging P against undesirable environmental influences (light, oxygen).

In the top region, the composite packaging P provides a pack gable-top panel 1, onto which a pouring element A, also according to the invention, is applied and permanently attached. When the pouring element A is actuated for the first time, a weakened region in the pack material which is concealed here by the pouring element A, is cut through and in this way, the composite packaging P is opened for the first time and is thus ready to be emptied. In the embodiment which is shown and preferred in this respect, this weakened region is formed as an over-coated hole which is formed during production: in this respect, a hole is punched in the cardboard carrier layer so that after this layer has been coated, a local weakening is produced.

Figure 2:
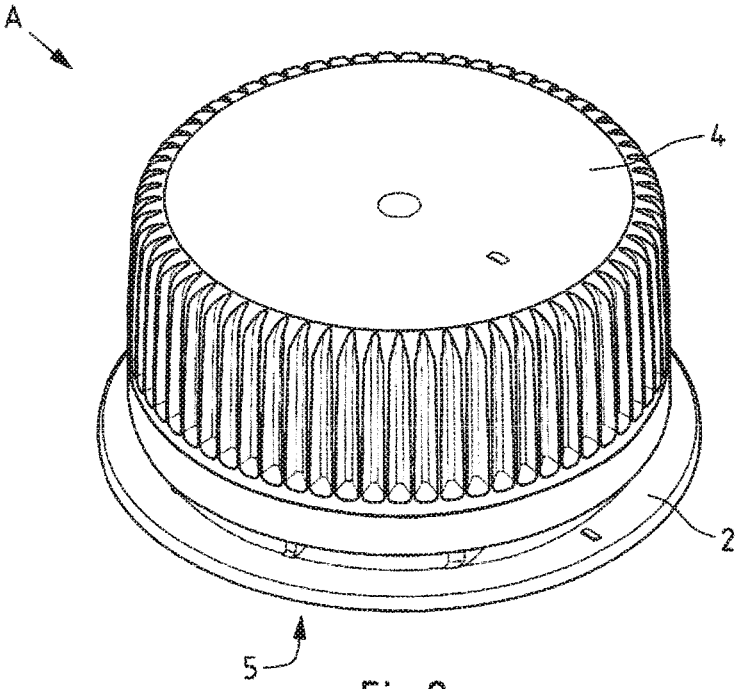
FIG. 2 shows a perspective view from above of a pouring element according to the invention.

FIG. 2 shows the pouring element A according to the invention, the parts of which, produced individually by injection moulding, have been ready assembled (put together): a basic body 2, a cutting element 3, concealed here, (shown in FIG. 4), and a closure cap 4. The pouring element A which is now ready for use is then applied to the composite packaging P over a fastening flange 5 and is permanently attached by hot melt adhesive.

When the closure cap 4 is actuated for the first time by the consumer, the unscrewing movement of the closure cap 4 is transferred to the cutting element 3 which is guided in the basic body 2 and which severs the composite packaging P in the region of the weakening. The product can then be poured out through the opening produced thus.

Figure 3:
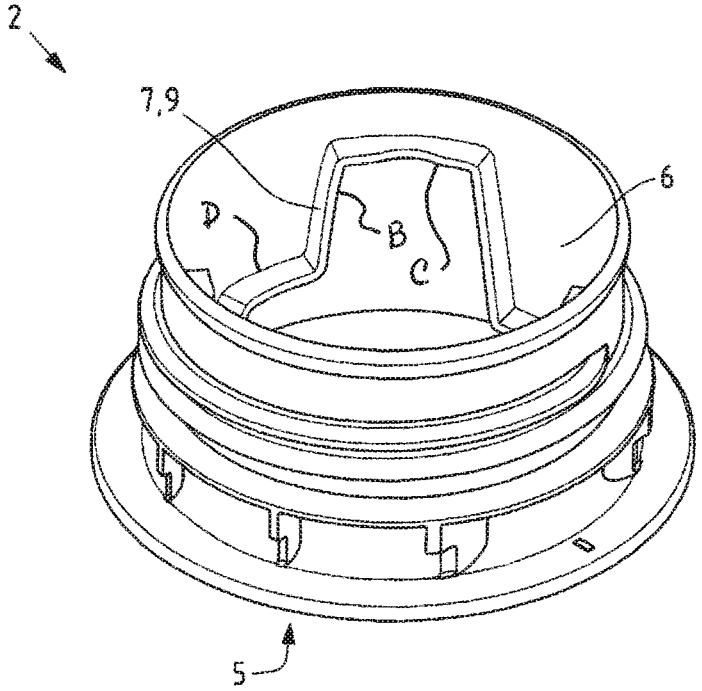
FIG. 3 shows a perspective view from above of the basic body of the pouring element from FIG. 2.

FIG. 3 shows the basic body 2 which consists of a pouring tube 6 in addition to the fastening flange 5. In the assembly and functional state, the cutting element 3 is arranged in the pouring tube 6 and is forcibly guided by first guide means 7, formed on the inner wall of the pouring tube, and by corresponding second guide means 8, formed on the cutting element (see FIG. 4). The first guide means 7 is formed by a peripheral web 9.

As further seen in FIG. 3, the first guide means 7 has a first segment B oriented in one direction and another segment C and yet another segment D, wherein each segment C and segment D is oriented in a different direction than segment B. The second guide means 8 is on the outer wall of the cutting element 3 and engages the first guide means 7.

Figure 4:
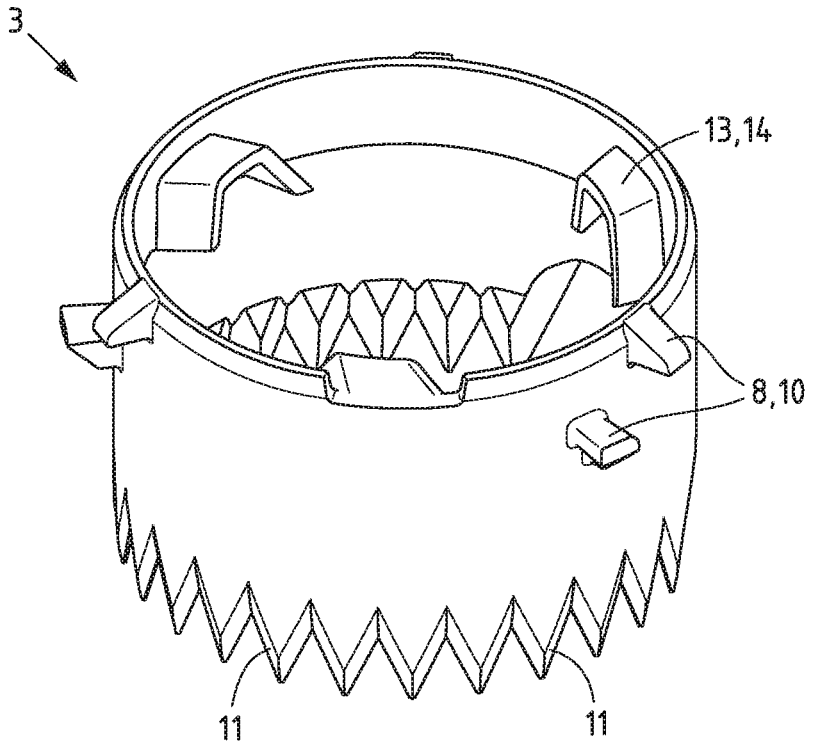
FIG. 4 shows a perspective view from above of the cutting element of the pouring element from FIG. 2.

FIG. 4 shows the cutting element 3 as an individual part. The mentioned second guide means 8 is realised as pairs of cams 10 which are arranged over the circumference and are formed integrally with the outer wall of the cutting element 3. The pairs of cams 10 enclose the web 9 and thus form a forced guidance of the cutting element 3 in the pouring tube 6 of the basic body 2. When used for the first time, the cutting element 3 moves according to its guidance in the direction of the over-coated hole in the composite packaging P, pierces and/or cuts through said hole by severing members 11 formed at the end of the cutting element 3. The cutting element 3 is driven by first drive means 12 which is formed on the closure cap 4 (see FIG. 7), the ribs 14 formed on the inner wall of the cutting element 3 act as second drive means 13 and thus start the cutting element 3 to move as has already been described.

Figure 5:
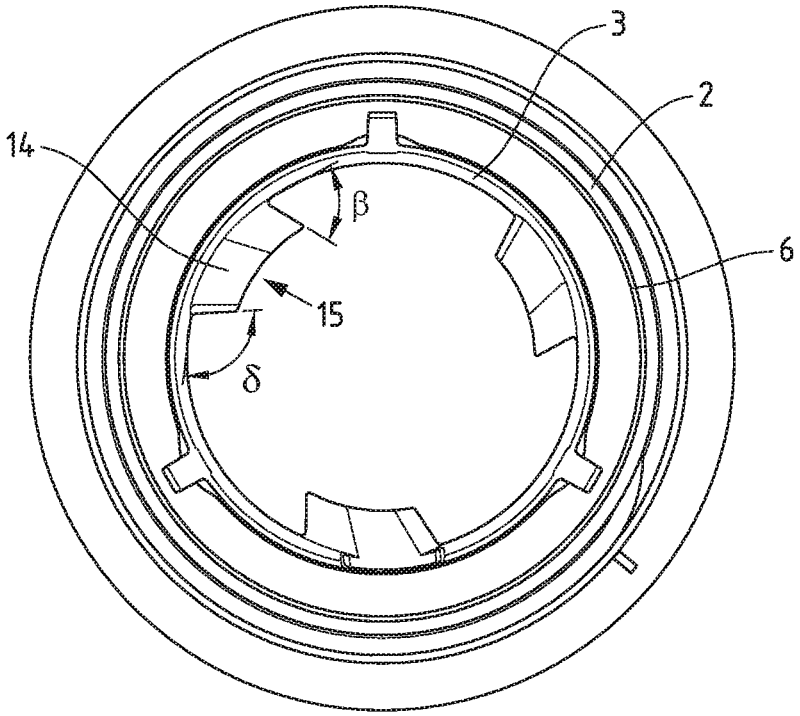
FIG. 5 shows a plan view of the basic body with an inserted cutting element of the pouring element from FIG. 2.

In FIG. 5, the cutting element 3 mounted in the pouring tube 6 of the basic body 2 is shown in the starting position. The plan view shows the valley angle β included in the foot region of a rib 14. The end face 15 of the rib 14 projects above the foot thereof on the drive side so that valley angle β is an acute angle. This acute valley angle β assists the guidance of the cutting element 3.

Figure 6:
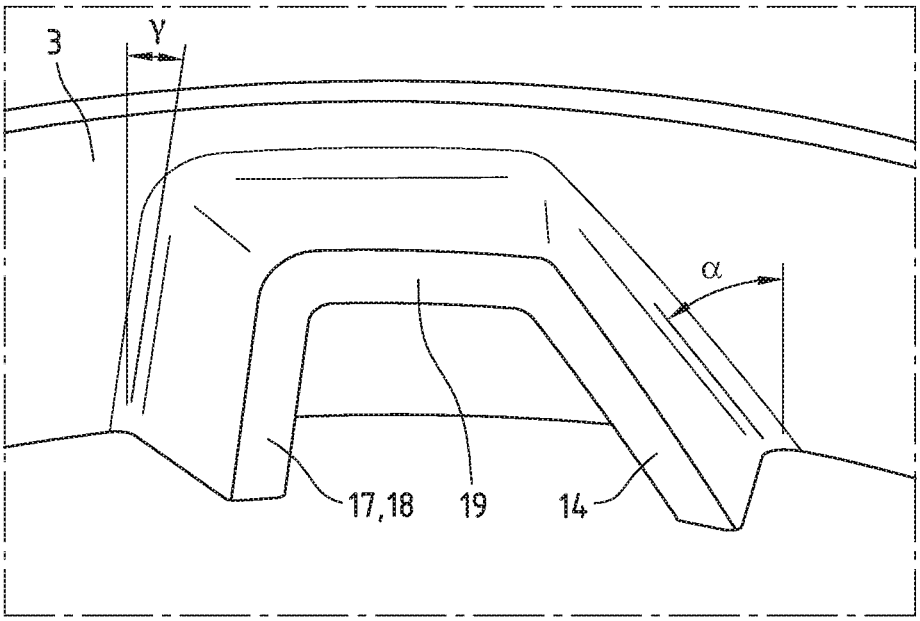
FIG. 6 shows a detail view of a drive means of the cutting element from FIG. 4.

FIG. 6 shows one of the ribs 14 in detail, which rib includes an angle α with the longitudinal direction of the cutting element 3. This allows an improved torque transmission from the closure cap 4 to the cutting element 3, the forced guidance of which in the pouring tube 6 of the basic body 2 forces the cutting element 3 along segment C and then along first segment B and/or along first segment B and then along segment D of the first guide means 7 thereby following a movement path with different gradients. In the embodiment which is shown and preferred in this respect, third drive means 16 is formed on the closure cap 4 (see FIG. 7) and fourth drive means 17 is formed on the cutting element 3. When the closure cap 4 is reclosed, these drive means comes into operative contact and bring the cutting element 3 into its end position. The fourth drive means 17 is formed as second ribs 18 and extend inclined by an angle γ to the longitudinal direction of the cutting element 3 and are also inclined by the obtuse angle δ (shown in FIG. 5), as a result of which this drive part is also optimised. A third rib 19 forms an additional piece between rib 14 and second rib 18 and joins them integrally.

Figure 7:
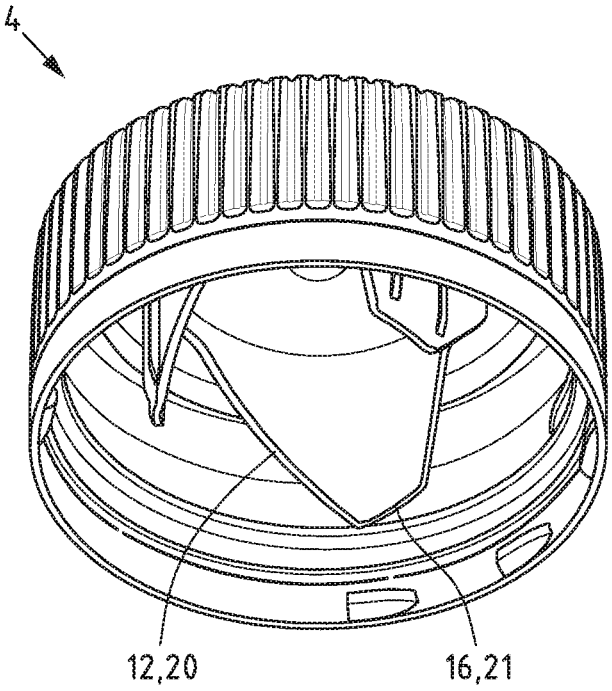
FIG. 7 shows a perspective internal view of the closure cap of the pouring element from FIG. 2.

Finally, FIG. 7 shows the closure cap 4. On the inside thereof, the first drive means 12 projects as first drive flanks 20 from the top into the interior of the closure cap 4. In the embodiment, the first drive flanks 20 are produced with relatively thin walls and on the contact surface side, they have the complementary angle to the valley angle β. Second drive flanks 21 are joined integrally to the first drive flanks 19 as third drive means 16. Thus, the closure cap 4 is coupled as a drive to cutting element 3 for the individual movements, and the desired transmission of force and torque can take place in a solidly guided manner.

The invention claimed is:

1. A pouring element for a composite packaging, in particular for a beverage carton for liquid foodstuffs, comprising:

a basic body having a fastening flange and a pouring tube;

a cutting element which is shaped as a hollow cylinder and arranged and guided in the pouring tube; and a closure cap which can be joined to the basic body, wherein during actuation for the first time by rotation of the cap relative to the basic body, the cutting element can be driven by a first drive means formed on the closure cap and by a second drive means formed on an inner wall of the cutting element, wherein an inner wall of the pouring tube has a first guide means with a first segment oriented in one direction and a second segment oriented in a different direction, wherein an outer wall of the cutting element has a second guide means which engages the first guide means and wherein movement of the cutting element follows the first segment and then the second segment of the first guide means along a movement path with different gradients, wherein the second drive means is configured as a rib extending obliquely to and thus includes a first angle with a longitudinal direction of the cutting element, and wherein the rib, on a drive-side rib foot, includes an acute valley angle.

2. The pouring element according to claim 1, wherein the first angle is greater than or equal to 40° and less than or equal to 50°.

3. The pouring element according to claim 1, wherein the acute valley angle is greater than or equal to 50° and less than or equal to 80°.

4. The pouring element according to claim 1, wherein during a first reclosing procedure, the cutting element can be driven further by a third drive means formed on the closure cap and by a fourth drive means formed on the cutting element.

5. The pouring element according to claim 4, wherein the fourth drive means is configured as a second rib which runs obliquely to and thus includes a second angle with the longitudinal direction of the cutting element.

6. The pouring element according to claim 5, wherein the second angle is greater than or equal to 5° and less than or equal to 25°.

7. The pouring element according to claim 5, wherein the second rib, on a contact surface side rib foot, includes an obtuse angle.

8. The pouring element according to claim 7, wherein the obtuse angle is greater than or equal to 100° and less than or equal to 130°.

9. The pouring element according to claim 5, wherein a third rib which stands transversely to the longitudinal direction is formed between the first rib and the second rib.

10. The pouring element according to claim 1, wherein the first drive means is configured as at least one drive flank.

11. The pouring element according to claim 10, wherein the at least one drive flank has an angular width on a contact surface side such that it forms with the valley angle β complementary angle.

12. The pouring element according to claim 4, wherein the third drive means is formed as at least one second drive flank.

13. A composite packaging, in particular a beverage carton for liquid foodstuffs, comprising:

a pack gable-top panel suitable for receiving a pouring element, wherein the pack gable-top panel has a local weakening in the pack material and a pouring element according to claim 1 is positioned and joined permanently such that when the pouring element is actuated for the first time, the cutting element is movable in the direction of the pack material weakening and said weakening can be severed so that the composite packaging is ready to be emptied.

14. The composite packaging according to claim 13, wherein the weakening in the pack material is formed as a prelaminated hole.

* * * * *